US005095941A

United States Patent [19]

Betz

[11] Patent Number: 5,095,941

[45] Date of Patent: Mar. 17, 1992

[54] METHOD AND APPARATUS FOR ACTUATING A FAUCET

[76] Inventor: John J. Betz, 2 W. Conrad Dr., Wilmington, Del. 19804

[21] Appl. No.: 544,334

[22] Filed: Jun. 27, 1990

[51] Int. Cl.[5] ..... F16K 31/14; F16K 37/00; E03B 1/04

[52] U.S. Cl. ..... 137/552; 137/607; 251/57; 251/129.04; 251/295; 4/192; 4/638; 34/90

[58] Field of Search ..... 137/551, 552, 606, 607, 137/801; 251/57, 129.04, 295; 4/192, 195, 623, 638; 34/90

[56] References Cited

U.S. PATENT DOCUMENTS

| | | | |
|---|---|---|---|
| 1,494,883 | 5/1924 | Bassette et al. | 4/638 |
| 2,281,370 | 4/1942 | Morrison et al. | 4/638 X |
| 2,504,740 | 4/1950 | Siegel | 34/90 X |
| 2,830,618 | 4/1958 | Mitchell | 251/295 X |
| 2,997,851 | 8/1961 | Trubert et al. | 251/57 X |
| 3,358,747 | 12/1967 | Lesher et al. | 4/638 X |
| 3,415,278 | 12/1968 | Yamamoto et al. | 137/607 |
| 3,450,159 | 6/1969 | Wilkin | 4/192 X |
| 3,638,680 | 2/1972 | Kopp | 251/129.04 X |
| 4,189,792 | 2/1980 | Veach | 4/192 |
| 4,336,619 | 6/1982 | Hinkel et al. | 34/90 X |
| 4,429,422 | 2/1984 | Wareham | 4/192 |

*Primary Examiner*—John Rivell
*Attorney, Agent, or Firm*—Elman & Wilf

[57] ABSTRACT

This device is an automatic faucet with three temperature settings activated by a pressure switch which is mounted on or near the floor by the user's foot. The invention includes a device which will, after a period of time, automatically turn the water off after the switch has been depressed. In the preferred embodiment, the user upon approaching the sink, could, by viewing indicator lights, readily discern whether a hot, cold or warm temperature setting has been selected.

11 Claims, 1 Drawing Sheet

METHOD AND APPARATUS FOR ACTUATING A FAUCET

FIELD OF THE INVENTION

This invention relates to faucets generally and to automatic faucets in particular. Some faucets, which are used in conjunction with sinks found in industrial washrooms, shop areas, restaurants, hospitals and other public washrooms enable the user of the faucet to actuate the faucet by using his or her foot, thus permitting the user's hands to remain free, typically for washing. This avoids unnecessary soiling of the sink and surrounding areas. These faucets also conserve water.

BACKGROUND OF THE INVENTION

It is commonplace to find in industrial settings such as washrooms and shop areas, sinks having automatic faucets. Such faucets enable a user with soiled hands and arms to actuate the faucet by activating a switch pedal or the like, which is mounted on or near the floor, by the user's foot. Such mechanisms offer certain advantages. One such advantage is that the user does not have to use soiled hands to actuate the normal on and off valves which are customarily mounted on the sink. This avoids undesirable material, which may be on the user's hands, from contaminating the upper portion of the sink as well as surrounding areas.

Another advantage of such automatic faucets is that they are generally constructed so that when the user's foot is removed from the foot actuated member the water is automatically turned off. This, of course, permits the amount of water used to be minimized, thus contributing to water conservation efforts.

An example of one such automatic faucet in the prior art is shown in U.S. Pat. No. 3,638,680 issued Feb. 1, 1972 to Hans W. Kopp entitled *Table With Liquid Outlet.* This patent teaches a remotely positioned pressure actuated device imbedded in a floor and connected to a sink mounted faucet.

SUMMARY OF THE INVENTION

Accordingly, a primary object of the present invention is to provide an improved sink mounted faucet which is provided with foot actuation means.

An additional object of the present invention is to provide a foot actuated faucet having means for permitting water to flow through the faucet for a predetermined amount of time after the foot actuation means has been depressed.

Another object of the present invention is to provide an automatic foot actuated faucet having means for controlling the temperature of the water flowing through the faucet.

It is still another object of the present invention to provide such an improved automatic faucet utilizing pneumatic foot actuation means in combination with solenoid actuated valves.

It is a further object of the present invention to provide an improved foot actuated faucet having indication means for indicating which water temperature has been selected.

Another object of the present invention is to provide an automatic faucet which can be operated manually as well as automatically.

These and other objects are accomplished by the present invention.

The invention includes a conventional faucet assembly having hot and cold manually operated valves mounted on the sink connected to a spigot but which has been modified or redesigned so as to have a third inlet. Such faucets may connect the valves to the spigot by pipes for receiving the hot and cold water which is in turn connected to the spigot or spout.

The foot actuated member is a pneumatic device. It is in turn connected to a pneumatic switch which sends signals to solenoid actuated water valves in the hot and cold water supply lines. The hot and cold water supply lines are, respectively, connected to the third inlet.

The invention may include an electrical switch which may be connected to indicator lights and to the solenoid actuated water valves so as to provide a means for selecting hot, cold or warm water temperatures.

The pneumatic switch may be located so that it may be operated by the user's foot or knee so as to facilitate its use. The pneumatic switch may also be connected to an electric hand dryer so as to preheat it while the user's hands are being washed so that the dryer will be ready for use. A needle valve may be used in conjunction with the pneumatic switch so as to permit the user to maintain the pressure on the pneumatic switch and maintain the faucet actuation for a predetermined amount of time.

BRIEF DESCRIPTION OF THE DRAWINGS

The construction of the preferred embodiment as well as further objects and advantages of the invention will become apparent from the following specification when considered with the accompanying drawing in which like numerals refer to like parts and wherein.

DESCRIPTION OF THE PREFERRED EMBODIMENT

Figure 1:
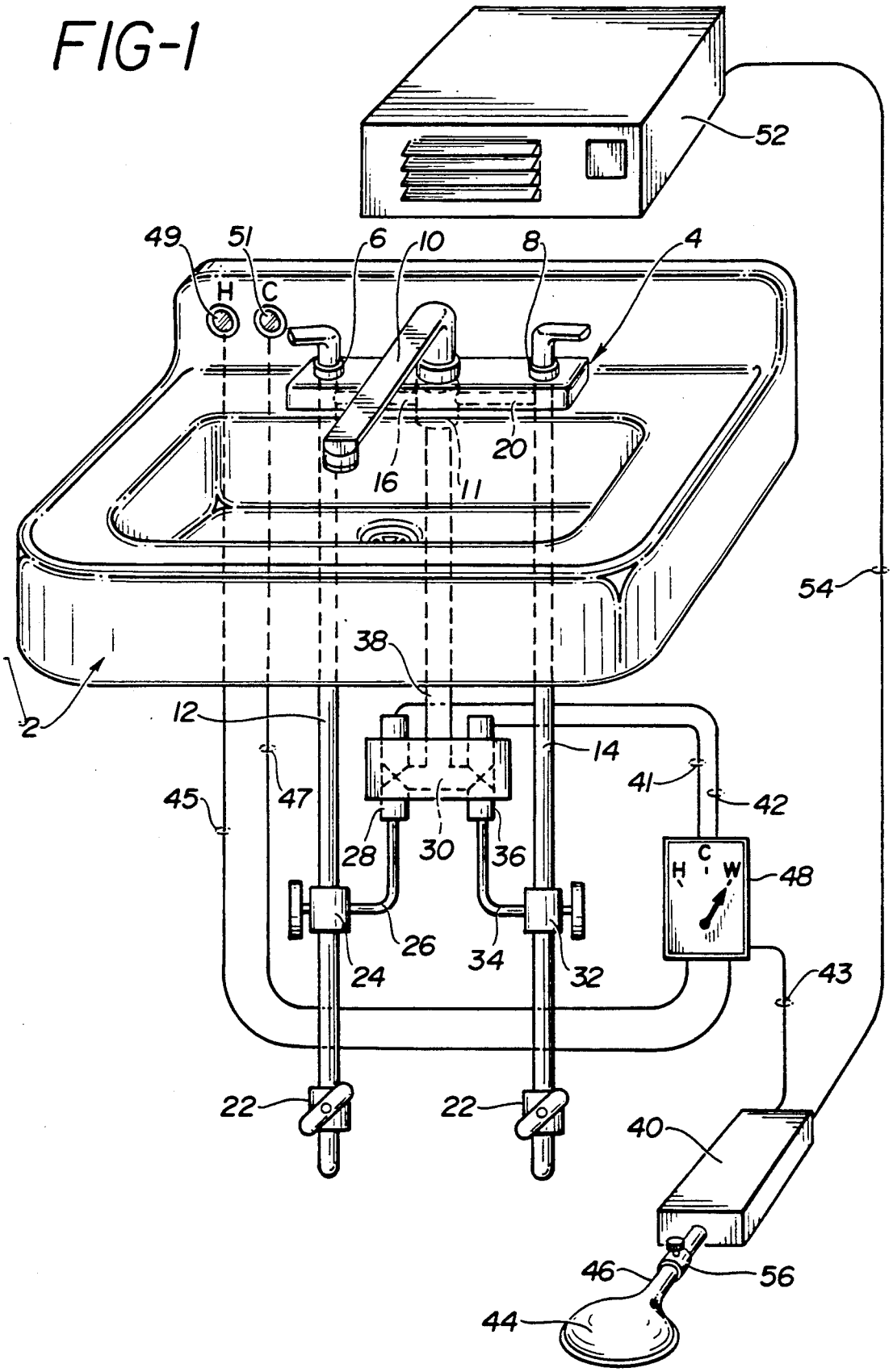
FIG. 1 shows the preferred embodiment of the invention with its various options.

The present invention includes a sink 2 and a conventional faucet assembly 4. The faucet assembly 4 has a hot water valve 6 and a cold water valve 8 as well as a spigot 10. A hot water pipe 12 feeds hot water to the hot water valve 6 and a cold water pipe 14 feeds cold water to the cold water valve 8 Pipe 16 permits hot water to pass from hot water valve 6 to the spigot 10. Similarly, a pipe 20 permits water to pass from the cold water valve 8 to spigot 10. The faucet assembly 4 has been modified or designed to include a third inlet fitting 11 connected to pipe 20.

Conventional manual shut off valves 22 are shown connected to the hot water pipe 12 and cold water pipe 14 so that maintenance and repairs can be effected. The structure just described is conventional and well known in the prior art.

A manual hot water valve 24 is shown in hot water pipe 12. Valve 24 is connected by pipe 26 to a solenoid operated water valve 28. Water flowing from pipe 12 through valve 24, through pipe 26, and thence through valve 28 passes to a pipe 30. Similarly, a manual cold water valve 32 is shown in cold water pipe 14. Valve 32 is connected by pipe 34 to a solenoid operated water valve 36 which is also connected to pipe 30. Water flowing from pipe 14 through valve 32, through pipe 34, and thence through valve 36 passes to pipe 30. Pipe 30 is connected to inlet fitting 11 by pipe 38.

Hot and cold water solenoid valves 28 and 36 are electrically connected to a pneumatically actuated electric switch 40 by pairs of wires 41 and 42 respectively and by a pair of wires 43. The pneumatically actuated electric switch 40 is operated by compression of air bulb 44 which is connected to switch 40 by tube 46. The air bulb 44 is shown positioned on the floor so that it may be depressed by the foot of an operator. However, the air bulb 44 may be positioned at any desireable location so that it may be actuated, for example, by the operator's knee.

Thus, a user may obtain water from the spigot 10 by manually turning hot and cold water valves 6 and 8 or by depressing air bulb 44.

In operation, hot water valve 24 and cold water valve 32 would be adjusted so that desirable water temperature is obtained when the faucet is actuated automatically when, through the use of air bulb 44, both hot and cold water valves 28 and 36 are actuated.

A three position electrical switch 48 is provided so that the operator may select either hot, cold or warm water. Switch 48 is connected to hot water solenoid valve 28 by a pair of wires 42, and to cold water solenoid valve 36 by a pair of wires 41. Switch 48 is connected to the pneumatically actuated electric switch 40 by a pair of wires 43. When switch 48 is placed in the warm position both the hot and cold water solenoid valves 28 and 36 will be opened by pneumatically actuated electric switch 40.

A red hot water indicator light 49 and a green cold water indicator light 51 are connected to sink 2, or wherever they may be conveniently seen, so as to indicate the temperature of the water which has been selected. If warm water has been selected, both lights 49 and 51 will be illuminated, thus the operator is made aware of which water temperature has been selected before water actually leaves spigot 10. Lights 49 and 51 are connected, respectively to switch 48 by pairs of wire 45 and 47.

Electrically operated hand dryers are in common use today. Many users of such devices find it annoying to have to turn the dryers on using their wet hands and then have to wait for the dryers to come up to full temperature. This problem may be solved by connecting such an electric dryer 52 to the pneumatically actuated electric switch 40 by pair of wires 54.

In using the invention, with all its features, a person desiring to use the automatic features of the present invention would, upon approaching the sink, readily discern the temperature setting and could, through the use of switch 48, alter the temperature setting. The person would then depress air bulb 44, causing water of the desired temperature to exit from the spigot 10 as well as causing actuation of the dryer 52.

The pneumatically actuated electric switch 40 could also contain a time delay mechanism 56 such as a needle valve. With this enhancement, depression of the air bulb 44 would actuate water flow through spigot 10, as well as actuating the dryer 52; however, due to the time delay mechanism 56, removal of foot pressure from air bulb 44 would cause all devices connected to pneumatically actuated electric switch 40 to remain operable for a predetermined amount of time. After air bulb 44 has been depressed switch 40 is actuated; needle valve 56 permits the air to bleed from the system thus causing switch 40 to be deactivated. The amount of time that switch 40 is actuated after depression of air bulb 44 may be varied by adjusting needle valve 56.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed is:

1. A faucet assembly which comprises:

a spigot;

a manually operated hot water valve operably connected to said spigot;

a manually operated cold water valve operably connected to said spigot;

the manually operated hot water valve being connected to a source of hot water and the manually operated cold water valve being connected to a source of cold water;

an electrically operated hot water valve operably connected to said source, of hot water and to said spigot;

an electrically operated cold water valve operably connected to said source of cold water and to said spigot;

a pneumatically actuated electric switch operably connected to said electrically operated hot water valve and to said electrically operated cold water valve;

a pressure means operably connected to said pneumatically actuated electric switch; and a pneumatic time delay mechanism operably connected between said pressure means and said pneumatically actuated electric switch; said mechanism having a selectively closable aperture constructed to release air from the pressure means at a selectable predetermined rate, whereby the faucet assembly may be operated automatically upon compression of said pressure means, said pneumatic time delay mechanism automatically causing water to cease flowing after a predetermined time even though said pressure means remains compressed, and the faucet assembly may be operated manually in the event of an electrical power failure.

2. The apparatus of claim 1 which includes a second manually operated hot water valve connected to said spigot and to said source of hot water; and a second manually operated cold water valve operably connected to said spigot and to said source of cold water.

3. The apparatus of claim 2 which further includes a third manually operated valve interposed between said hot water source and said electrically operated hot water valve and a fourth manually operated valve interposed between said cold water source and said electrically operated cold water valve.

4. The apparatus of claim 3 wherein adjustment means is operably connected to said electrically operated hot water valve and said electrically operated cold water valve; whereby water of varying temperature can be provided to said spigot.

5. The apparatus of claim 4 wherein said adjustment means is operably connected to an indication means whereby indication is given to a user of the apparatus of the position of the adjustment means.

6. The apparatus of claim 5 wherein said indication means include a red light activation thereof indicating selection of hot water, a green light, activation thereof indicating selection of cold water and wherein activation of both of said lights indicates the selection of warm water.

7. The apparatus of claim 1 which includes means for actuating an electrical dryer when said pneumatically actuated electric switch is actuated.

8. The apparatus of claim 1, wherein the selectively closable aperture is controlled by a needle valve.

9. A method of controlling the flow of water from a water source to a spigot, the method comprising the steps of:

maintaining compression of a pneumatic device;

actuating a pneumatic switch having an actuated condition and a deactuated condition in response to the compression of said pneumatic device, thereby generating an actuation signal which is continuous while the pneumatic switch is in the actuated condition;

transmitting said actuation signal to an electrically operated water valve interposed between a water source and a spigot;

opening said valve in response to said actuation signal, thus causing water to flow from said water source through said spigot; and permitting air to bleed slowly from the pneumatic device until the pneumatic switch is in the deactuated condition, thereby interrupting the actuation signal being transmitted, causing the electrically operated water valve to close, and causing water to cease flowing from said water source through the spigot.

10. The method of claim 9, wherein air is permitted to bleed slowly from the pneumatic device by a pneumatic time delay mechanism having a selectively closable aperture for bleeding air from the pneumatic device.

11. The method of claim 10, wherein the selectively closable aperture is controlled by a needle valve.

* * * * *